US006021575A

United States Patent [19]

Thieben

[11] Patent Number: 6,021,575

[45] Date of Patent: Feb. 8, 2000

[54] TRACING SYSTEM

[76] Inventor: Bernard L. Thieben, 12017 N. Riverview Rd., Chillicothe, Ill. 61523

[21] Appl. No.: 09/036,405

[22] Filed: Mar. 5, 1998

[51] Int. Cl.[7] ..... B43L 13/10

[52] U.S. Cl. ..... 33/23.08; 33/41.5

[58] Field of Search ..... 33/23.01, 23.02, 33/23.1, 23.05, 23.08, 24.1, 27.12, 41.5, 41.6, 42, 551, 553, 554

[56] References Cited

U.S. PATENT DOCUMENTS

| | | | |
|---|---|---|---|
| 38,720 | 6/1863 | Atwater | 33/27.12 |
| 317,309 | 5/1885 | Cox | 33/41.5 |
| 967,448 | 8/1910 | Sehler | 33/41.5 |
| 1,416,357 | 5/1922 | Knuusi | 33/41.5 |
| 2,660,791 | 12/1953 | Howell | 33/41.6 |

FOREIGN PATENT DOCUMENTS

| | | | |
|---|---|---|---|
| 2204177 | 11/1988 | United Kingdom | 33/41.6 |

*Primary Examiner*—G. Bradley Bennett

[57] ABSTRACT

A new tracing system for tracing complex profile shapes. The inventive device includes a right triangular base comprising a vertical side portion and a horizontal base portion. A diagonal connecting brace extends between the vertical side portion and the horizontal base portion. An elongated guide bar is secured to the vertical side portion of the right triangular base. A spring-loaded marker holder is coupled with an open lower end of the elongated guide bar. A marker is secured to the spring-loaded marker holder.

6 Claims, 2 Drawing Sheets

TRACING SYSTEM

BACKGROUND OF THE INVENTION

1. Field of the Invention

The present invention relates to graphic aid devices and more particularly pertains to a new tracing system for tracing complex profile shapes.

2. Description of the Prior Art

The use of graphic aid devices is known in the prior art. More specifically, graphic aid devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art graphic aid devices include U.S. Pat. No. 5,165,175 to Anderson; U.S. Pat. No. 4,554,740 to Gill; U.S. Pat. No. Des. 252,380 to Kupperman et al.; U.S. Pat. No. 4,390,491 to Woodall; U.S. Pat. No. 4,561,183 to Shores; and U.S. Pat. No. 4,397,090 to Nicyper.

While these devices fulfill their respective, particular objectives and requirements, the aforementioned patents do not disclose a new tracing system. The inventive device includes a right triangular base comprising a vertical side portion and a horizontal base portion. A diagonal connecting brace extends between the vertical side portion and the horizontal base portion. An elongated guide bar is secured to the vertical side portion of the right triangular base. A spring-loaded marker holder is coupled with an open lower end of the elongated guide bar. A marker is secured to the spring-loaded marker holder.

In these respects, the tracing system according to the present invention substantially departs from the conventional concepts and designs of the prior art, and in so doing provides an apparatus primarily developed for the purpose of tracing complex profile shapes.

SUMMARY OF THE INVENTION

In view of the foregoing disadvantages inherent in the known types of graphic aid devices now present in the prior art, the present invention provides a new tracing system construction wherein the same can be utilized for tracing complex profile shapes.

The general purpose of the present invention, which will be described subsequently in greater detail, is to provide a new tracing system apparatus and method which has many of the advantages of the graphic aid devices mentioned heretofore and many novel features that result in a new tracing system which is not anticipated, rendered obvious, suggested, or even implied by any of the prior art graphic aid devices, either alone or in any combination thereof.

To attain this, the present invention generally comprises a right triangular base comprising a vertical side portion and a horizontal base portion. A diagonal connecting brace extends between the vertical side portion and the horizontal base portion. An elongated guide bar is secured to the vertical side portion of the right triangular base by a pair of clamps. The guide bar has open upper and lower ends. The open upper end has a cap removably disposed thereover. A spring-loaded marker holder is coupled with the open lower end of the elongated guide bar. The marker holder includes a base portion secured within the open lower end of the guide bar. A spring is disposed within the guide bar between the base portion and the upper end of the guide bar. A marker is secured to the base portion of the spring-loaded marker holder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new tracing system apparatus and method which has many of the advantages of the graphic aid devices mentioned heretofore and many novel features that result in a new tracing system which is not anticipated, rendered obvious, suggested, or even implied by any of the prior art graphic aid devices, either alone or in any combination thereof.

It is another object of the present invention to provide a new tracing system which may be easily and efficiently manufactured and marketed.

It is a further object of the present invention to provide a new tracing system which is of a durable and reliable construction.

An even further object of the present invention is to provide a new tracing system which is susceptible of a low cost of manufacture with regard to both materials and labor, and which accordingly is then susceptible of low prices of sale to the consuming public, thereby making such tracing system economically available to the buying public.

Still yet another object of the present invention is to provide a new tracing system which provides in the apparatuses and methods of the prior art some of the advantages thereof, while simultaneously overcoming some of the disadvantages normally associated therewith.

Still another object of the present invention is to provide a new tracing system for tracing complex profile shapes.

Yet another object of the present invention is to provide a new tracing system which includes a right triangular base comprising a vertical side portion and a horizontal base portion. A diagonal connecting brace extends between the vertical side portion and the horizontal base portion. An elongated guide bar is secured to the vertical side portion of the right triangular base. A spring-loaded marker holder is coupled with an open lower end of the elongated guide bar. A marker is secured to the spring-loaded marker holder.

Still yet another object of the present invention is to provide a new tracing system that provides a way for a person to accurately duplicate a complex profile shape on a template.

Even still another object of the present invention is to provide a new tracing system that is useful in cutting wood, stones, tiles, linoleum, and other materials to fit around existing features.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
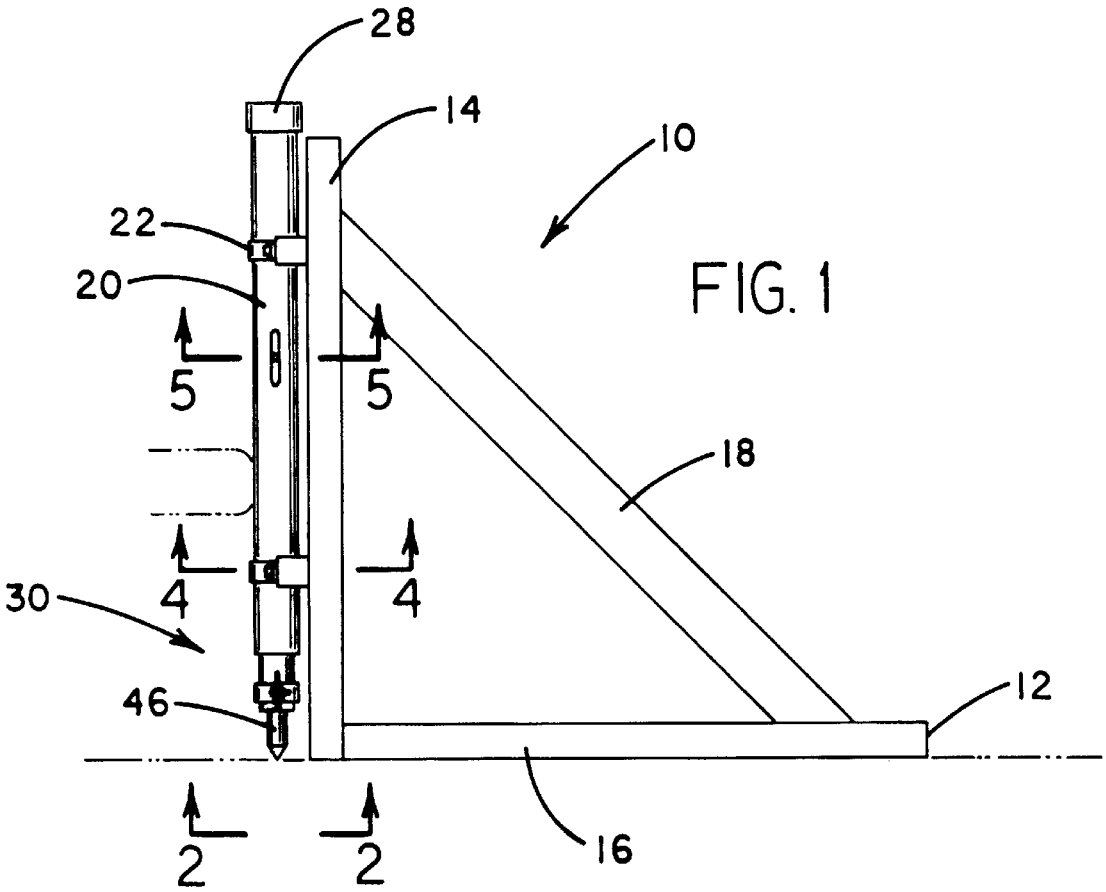
FIG. 1 is a side elevation view of a new tracing system according to the present invention.
Figure 2:
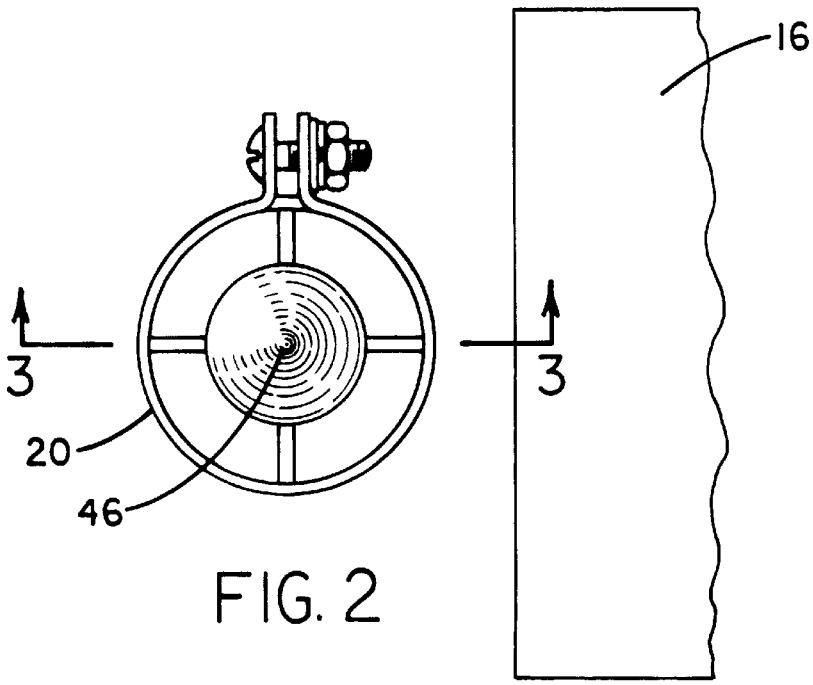
FIG. 2 is a boot sectional view of the marking tool and retainer of the present invention as taken along line 2—2 of FIG. 1.
Figure 3:
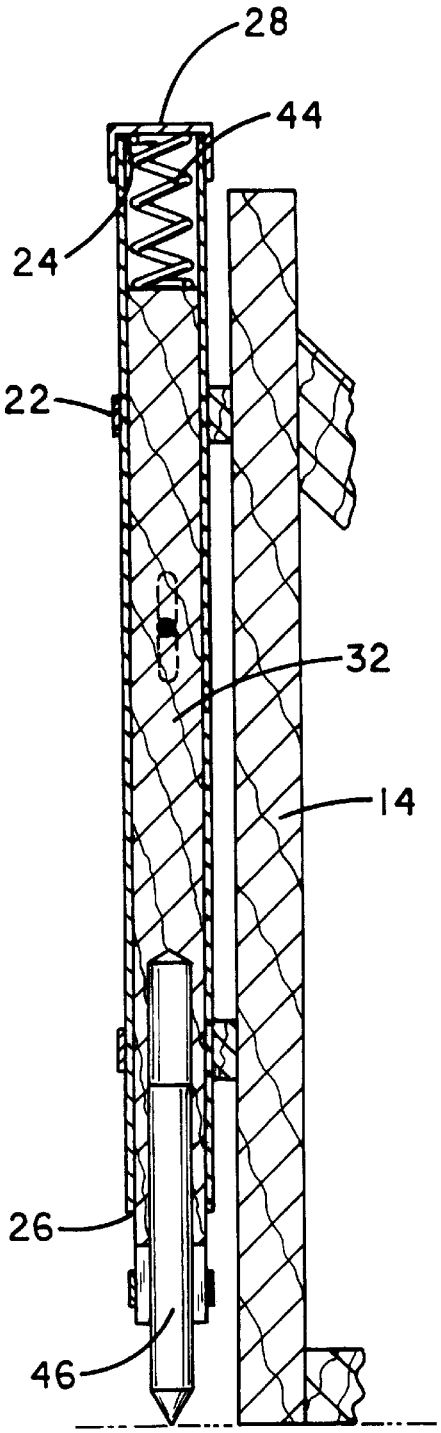
FIG. 3 is a cross-sectional view of the present invention as taken along line 3—3 of FIG. 2.
Figure 4:
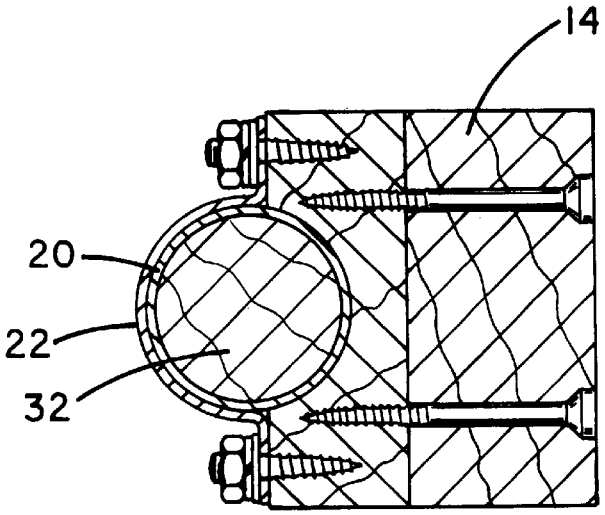
FIG. 4 is a cross-sectional view of the present invention as taken along line 4—4 of FIG. 1.
Figure 5:
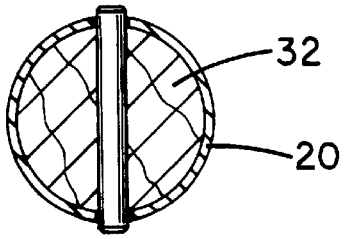
FIG. 5 is a cross-sectional view of the present invention as taken along line 5—5 of FIG. 1.

With reference now to the drawings, and in particular to FIGS. 1 through 5 thereof, a new tracing system embodying the principles and concepts of the present invention and generally designated by the reference numeral 10 will be described.

As best illustrated in FIGS. 1 through 5, the tracing system 10 comprises a right triangular base 12. The base 12 is preferably constructed of wood stock, with two sides and a diagonal connecting brace 18. Along the vertical side portion 14, a metal guide bar 20 would be attached via a number of retaining straps or clamps 22. At its base, the guide bar 20 would having a spring-loaded holder 30 for a marking tool 46.

The right triangular base 12 comprises a vertical side portion 14 and a horizontal base portion 16. The diagonal connecting brace 18 extends between the vertical side portion 14 and the horizontal base portion 16.

The elongated guide bar 20 is secured to the vertical side portion 14 of the right triangular base 12 by a pair of clamps 22. The guide bar 20 has open upper 24 and lower ends 26. The open upper end 24 has a cap 28 removably disposed thereover.

The spring-loaded marker holder 30 is coupled with the open lower end 26 of the elongated guide bar 20. The marker holder 30 includes a base portion 32 received within the open lower end 26 of the guide bar 20. A spring 44 is disposed on within the marker holder 30 on an upper end of the base portion 32.

The marker 46 is secured to base portion 32 of the spring-loaded marker holder 30. The marker 46 is received within a channel formed within a lower end of the base portion 32.

In use, in order for a user to make a template or mark materials to be cut to fit around a desired profile shape, they would simply place the material being marked adjacent to the profile being traced and the place the present invention on the material. The present invention would be positioned so that the guide bar 20 was against the profile being traced, and the horizontal base portion 16 of the triangular base 12 was flat on the material, keeping the marker 46 perfectly perpendicular to the material. The profile shape would then be carefully traced with the product, duplicating the shape on the template or the material which was actually being cut to fit.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tracing system for tracing complex profile shapes comprising:

a right triangular base comprising a vertical side portion and a horizontal base portion, a diagonal connecting brace extending between the vertical side portion and the horizontal base portion for holding the side portion in a substantially perpendicular relationship to the base portion;

an elongated guide bar secured to the vertical side portion of the right triangular base by a pair of clamps, the guide bar having open upper and lower ends, the open upper end having a cap removably disposed thereover, the guide bar having a substantially circular cross section with a cylindrical outer pattern contact surface for abutting against a profile of a pattern and being moved along the profile of the pattern;

a spring-loaded marker holder coupled with the open lower end of the elongated guide bar, the marker holder including a base portion received in the open lower end of the guide bar, a spring disposed in the guide bar and disposed on an upper end of the base portion, the marker holder being adapted such that the marker holder is isolated from contact with any pattern against which the guide bar is abutted; and a marker secured to a lower end of the base portion of the spring-loaded marker holder, the marker having a tapering tip for marking on a surface, the tapering tip being substantially centered in the marker holder such that the tapering tip is radially inward from outer pattern contact surface of the marker holder.

2. A tracing system for tracing complex profile shapes comprising:

a base assembly comprising an upstanding side portion and a base portion with a lower surface for resting on a surface to be marked;

an elongated guide bar secured to the side portion of the base assembly, the guide bar having a substantially circular cross section with a cylindrical outer pattern contact surface for abutting against a profile of a pattern and being moved along the profile of the pattern;

a spring-loaded marker holder coupled with an open lower end of the elongated guide bar; and a marker secured to the spring-loaded marker holder.

3. The tracing system as set forth in claim 2 wherein the marker holder includes a base member secured in the open lower end of the guide bar, a spring disposed in the guide bar between the base member and an upper end of the guide bar.

4. The tracing system as set forth in claim 2 additionally comprising a diagonal connecting brace extending between the side portion and the base portion of the base for holding the side portion in a substantially perpendicular relationship to the base portion.

5. The tracing system as set forth in claim 2 wherein the marker has a tapering tip for marking on a surface, the tapering tip being substantially centered in the marker holder such that the tapering tip is centered radially inward from outer pattern contact surface of the marker holder.

6. The tracing system as set forth in claim 2 wherein the marker holder is adapted such that the marker holder is isolated from contact with any pattern against which the guide bar is abutted.

* * * * *